US008353079B2

(12) United States Patent
Marshall

(10) Patent No.: US 8,353,079 B2
(45) Date of Patent: Jan. 15, 2013

(54) ELEVATOR HOISTWAY DOOR CLOSER

(76) Inventor: Kelly L. Marshall, San Antonio, TX (US); Chris Marshall, legal representative, San Antonio, TX (US)

( * ) Notice: Subject to any disclaimer, the term of this patent is extended or adjusted under 35 U.S.C. 154(b) by 180 days.

(21) Appl. No.: 12/927,917

(22) Filed: Oct. 22, 2010

(65) Prior Publication Data

US 2011/0266098 A1 Nov. 3, 2011

Related U.S. Application Data

(63) Continuation of application No. 10/346,788, filed on Jan. 21, 2003, now abandoned.

(51) Int. Cl.
*E05F 1/08* (2006.01)
*E05F 1/10* (2006.01)

(52) U.S. Cl. ..... 16/77; 16/78

(58) Field of Classification Search ..... 16/71, 72, 16/77, 75, 76, 78, 193, 197, 198; 242/602.1, 242/602.2, 602.3, 603, 611.1, 613.1, 613.2, 242/613.3, 407, 376; 267/156; 49/404, 360; 187/333, 340, 325

See application file for complete search history.

(56) References Cited

U.S. PATENT DOCUMENTS

| | | | | | |
|---|---|---|---|---|---|
| 7,132 | A | | 3/1850 | Bernard | |
| 146,675 | A | * | 1/1874 | Holwell | 242/602.1 |
| 821,708 | A | | 5/1906 | Edward | |
| 1,183,402 | A | * | 5/1916 | Prescott | 160/193 |
| 1,795,452 | A | | 3/1931 | Smelser | |
| 2,793,740 | A | | 5/1957 | Davdt | |
| 2,855,162 | A | | 10/1958 | Schacht | |
| 2,992,450 | A | * | 7/1961 | Pittenger | 16/78 |
| 3,085,768 | A | | 4/1963 | Treutelaar | |
| 3,160,250 | A | * | 12/1964 | Bridwell | 16/78 |
| 3,267,513 | A | * | 8/1966 | Wartian | 16/78 |
| 3,311,159 | A | | 3/1967 | Stansberry | |
| 3,480,227 | A | * | 11/1969 | Matthews | 16/78 |
| 3,502,280 | A | * | 3/1970 | Matthews et al. | 16/78 |
| 3,756,585 | A | * | 9/1973 | Mihalcheon | 16/78 |
| 3,831,870 | A | | 8/1974 | Daniel | |
| 4,003,102 | A | * | 1/1977 | Hawks et al. | 16/72 |
| 4,301,623 | A | * | 11/1981 | Demukai | 49/404 |
| 4,330,960 | A | * | 5/1982 | Hasemann et al. | 49/404 |
| 4,675,938 | A | * | 6/1987 | Bundschuh | 16/78 |
| 4,728,141 | A | * | 3/1988 | Motozawa et al. | 242/376 |
| 4,757,642 | A | * | 7/1988 | Hahn | 16/77 |

(Continued)

FOREIGN PATENT DOCUMENTS

AU 113360 7/1941

(Continued)

*Primary Examiner* — Jeffrey O Brien

(57) ABSTRACT

Elevator hoistway door closer device that increases the closing force on the door as the door approaches the door closed position. A elevator hoistway door closer includes a reel having a groove in its side that terminates in a flat edge beyond a breakover angle. The groove may have a first portion of essentially constant diameter and a second portion having a conical helix shape. The third portion includes the breakover angle and may terminate in a flat edge. There may be an elongate tensile element received by the first and second portions and the third portion defined by the breakover angle flat edge, and that has a free end for attachment to a fixed point. There may be a spring for rotating the reel and attracting the elongate tensile element by wrapping the elongate tensile element around the first and second portions of the channel and over the breakover angle and flat edge of the third portion.

8 Claims, 6 Drawing Sheets

U.S. PATENT DOCUMENTS

| | | | | | |
|---|---|---|---|---|---|
| 4,914,780 | A | | 4/1990 | Rogers et al. | |
| 5,054,162 | A | | 10/1991 | Rogers | |
| 5,063,676 | A | | 11/1991 | Gerber | |
| 5,103,890 | A | | 4/1992 | Cloutier | |
| 5,259,433 | A | | 11/1993 | Cloutier | |
| 5,630,249 | A | * | 5/1997 | Rebai, Jr. | 16/77 |
| 5,937,478 | A | * | 8/1999 | Regnier | 16/78 |
| 6,021,607 | A | * | 2/2000 | Angove | 49/404 |
| 6,390,535 | B1 | * | 5/2002 | Chapman | 49/360 |
| 6,983,785 | B2 | * | 1/2006 | Altimore | 16/72 |
| 7,537,042 | B2 | * | 5/2009 | Altimore | 16/72 |
| 7,546,904 | B2 | * | 6/2009 | Wernas | 16/72 |
| 8,025,090 | B2 | * | 9/2011 | Kicher | 160/191 |

FOREIGN PATENT DOCUMENTS

| | | | | |
|---|---|---|---|---|
| DE | 3144498 | A1 | | 8/1983 |
| GB | 2039325 | A | * | 8/1980 |
| GR | 116347 | | | 5/1900 |
| GR | 600609 | | | 7/1934 |

* cited by examiner

C–C

ELEVATOR HOISTWAY DOOR CLOSER

CROSS-REFERENCE TO RELATED APPLICATION

The present application is a continuation in part of U.S. patent application Ser. No. 10/346,788, entitled "METHOD AND APPARATUS FACILITATING CLOSURE OF HOISTWAY DOOR," filed Jan. 21, 2003, which is herein incorporated by reference as if fully set forth in its entirety for its pertinent and supportive teachings.

BACKGROUND OF THE INVENTION

1. Field of the Invention

The present invention relates to elevator safety devices. More particularly, the invention relates to a mechanical elevator hoistway door closer for increasing the closing force on the elevator hoistway door as the door approaches the door closed position to overcome wind velocities and air pressurizations in elevator hoistways.

2. Description of the Prior Art

Modern elevator installations typically comprise a hoistway door assembly 10 with one or more hoistway door panels 41 on each landing to block access to the hoistway when the elevator cab is not present. As shown in FIG. 1, hoistway door panels 41 are typically suspended from the hoistway header 16 by a plurality of hangers 11. The panels 41 are usually affixed to the hangers 11 with conventional mounting bolts 14. The hangers 11, which usually comprise one or more pulleys 12, allow lateral translation of the door panels 41 along a track 15 affixed to the hoistway header 16. A relating cable 17 is generally provided in multiple panel installations in order to coordinate the opening and closing of the panels 41. As is generally known to those of ordinary skill in the art, a relating cable door clamp 18 affixed to one hoistway door panel 41, and a relating cable dead end clamp 19 affixed to the other hoistway door panel 41 establishes the desired operating relationship between the panels 41.

As is also known to those of ordinary skill in the art, the hoistway panels 41 of a hoistway door assembly 10 are opened and closed in normal operation through interaction with the cab door (not shown) as the cab comes to rest at a particular landing. In particular, a power door-operator, which is normally located atop the cab, opens or closes the cab door through a drive arm, cable, belt, screw drive, or the like. A clutch mechanism engages a roller assembly 20 to couple the cab door to the hoistway door assembly 10 for opening and closing. A vertically disposed clutch on the cab door then engages an upper clutch roller 22 and lower clutch roller 23 as the cab settles upon a landing. Because the lower clutch roller 23 is generally offset from the upper clutch roller 22, engagement of the clutch with the rollers 22, 23 serves to release a mechanical latching device 25 through an interposed clutch linkage 24. Release of the mechanical latching device 25 allows the hoistway door panels 41 to be opened as a lateral force is applied from the cab door to the rollers 22, 23 through the clutch.

As the cab prepares to leave a particular landing, the power door operator reverses the position of the drive arm (or other device) to force the cab doors closed. The clutch engages the rollers 22, 23 from their side opposite that engaged during the opening operation, thereby forcing the hoistway door 41 closed and re-engaging the mechanical latching device 25. Additionally, electrical contacts 26, typically collocated with the mechanical latching device 25 in an interlock assembly, will then signal the elevator controller to confirm that the hoistway door 41 has in fact been closed, enabling the elevator cab to depart the landing.

Because the device 25 may fail, however, additional safety devices are generally required in order to ensure that the hoistway door panels 41 close and remain closed if, for any reason, the elevator cab leaves the landing prior to door closing. Typically, a door closer device 27 is provided to facilitate and ensure closing of the hoistway door panels 41. In the past, the door closer device 27 has generally comprised a closer reel attached to one of the hoistway door assembly 10 by a bearing or bushing assembly 30 located in a passage 42 around the central axis 31 of the door closer device 27. A spring 32 within a spring cavity 28 engages a ratchet 29 within the door closer device 27 to produce tension on a closer reel cable 33, which may be extended from the door closer device 27. A distal end of the closer reel cable 33, generally terminated with a cable eyelet 34, is fixedly secured to the hoistway header 16 through a cap screw 35. As is known to those of ordinary skill in the art, however, the cable eyelet 34 may, in multiple door installations, be affixed to a second hoistway door panel 41. Likewise, as is known to those of ordinary skill in the art, the door closer device 27 could be affixed off of the hoistway door assembly 10—for example, on the hoist-way header 16, while the cable 33 is affixed to one of the door panels 41.

In operation, as the hoistway door panels 10 open, the closer reel cable 33 is extended from the door closer device 27. As the closer reel cable 33 is pulled from the doors closer device 27, increasing opposing force is applied on the reel cable 33 from the spring 32. In the event of an electrical or mechanical failure preventing the otherwise normal closing of the hoistway door 10, tension on the closer reel cable 33 serves to ensure 15 that the hoistway door 10 closes and remains closed. Unfortunately, elevator hoistway door closers as presently known the art are often ineffective in extreme conditions.

In windy areas, such as coastal or lakeshore regions, or in air conditioned buildings with windows that may be opened, an inrush of air is often created during heavy traffic hours as a result of the negative pressure in the building. This inrush of air causes an air current in the hoistway, which acts as an air duct. As the elevator cab reaches a landing, air pressure within the hoistway escapes rapidly through the hoistway door assembly 10. As the door panels 41 attempt to close, a jet nozzle effect is created whereby the resultant high wind velocity puts such a stress on the hoistway door assembly 10 that the door panels 41 often fail to close, causing the elevator to initiate a recycle mode. In this condition, the known door closer devices 27 are generally unable to force the hoistway door panels 41 to close. To date, the solution to this problem has resided in a call-back for maintenance for the elevator. In response to the call-back, the service technician generally adds a loop of the closer reel cable 23 about the closer reel, thereby increasing tension on the spring 32. Unfortunately, as wind conditions change, or traffic flows through the building lessen, the excess tension on the closer reel cable 33 can cause the hoistway door panels 41 to close too rapidly in the absence of the jet nozzle effect. The door panels 41 come together with excess force, and the result is again that the elevator enters a recycle mode and fails to operate. To date, as before, the typical response has been yet another maintenance call-back where the service technician will remove the previously added cable loop from about the closer reel. Door closure problems are presently the leading cause of elevator service calls.

Therefore, a need exists for a new and improved closer device that can be used for elevator hoistway doors. In this regard, the present invention substantially fulfills this need. In this respect, the closer device according to the present invention substantially departs from the conventional concepts and designs of the prior art, and in doing so provides an apparatus primarily developed for the purpose of overcoming wind velocities and air pressurizations in elevator hoistways.

SUMMARY OF THE INVENTION

In view of the foregoing disadvantages inherent in the known types of hoistway door closer devices now present in the prior art, the present invention provides an improved hoistway door closer, and overcomes the above-mentioned disadvantages and drawbacks of the prior art. As such, the general purpose of the present invention, which will be described subsequently in greater detail, is to provide a new and improved closer devise which has all the advantages of the prior art mentioned heretofore and many novel features that result in a closer device which is not anticipated, rendered obvious, suggested, or even implied by the prior art, either alone or in any combination thereof.

To attain this, the present invention essentially generally comprises a reel having a groove in its side that terminates beyond a break over angle. There has thus been outlined, rather broadly, the more important features of the invention in order that the detailed description thereof that follows may be better understood and in order that the present contribution to the art may be better appreciated.

The invention may also include the groove having a first portion of essentially constant diameter and a second portion having a conical helix shape. A third portion includes the breakover angle and flat channel. There may be an elongate tensile element received by the first and second portions and passing over third portion of the breakover angle and flat channel that has a free end for attachment to a fixed point. There may be a spring for rotating the reel and attracting the elongate tensile element by wrapping the elongate tensile element around the first and second portions of the channel and over the third portion breakover angle and flat channel. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved elevator hoistway door closer device that has all of the advantages of the prior art door closer devices and none of the disadvantages.

It is another object of the present invention to provide a new and improved elevator hoistway door closer device that may be easily and efficiently manufactured and marketed.

An even further object of the present invention is to provide a new and improved elevator hoistway door closer device that has a low cost of manufacture with regard to both materials and labor, and which accordingly is then susceptible of low prices of sale to the consuming public, thereby making such a closer device economically available to the buying public.

Still another object of the present invention is to provide a new elevator hoistway door closer device that provides in the apparatuses and methods of the prior art some of the advantages thereof, while simultaneously overcoming some of the disadvantages normally associated therewith.

It is therefore an overriding object of the present invention to improve upon the prior art by providing an elevator hoistway door closer device and method that is able to effectively operate an elevator hoistway door in a variety of weather and/or usage conditions.

It is a further object of the present invention to provide such a door closer device that is reverse compatible with existing installations and of comparable expense to those presently available.

Lastly, it is yet another object of the present invention to provide such a door closer device that has an extended life cycle, thereby reducing cost to the elevator owner and maintaining elevator contractor.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
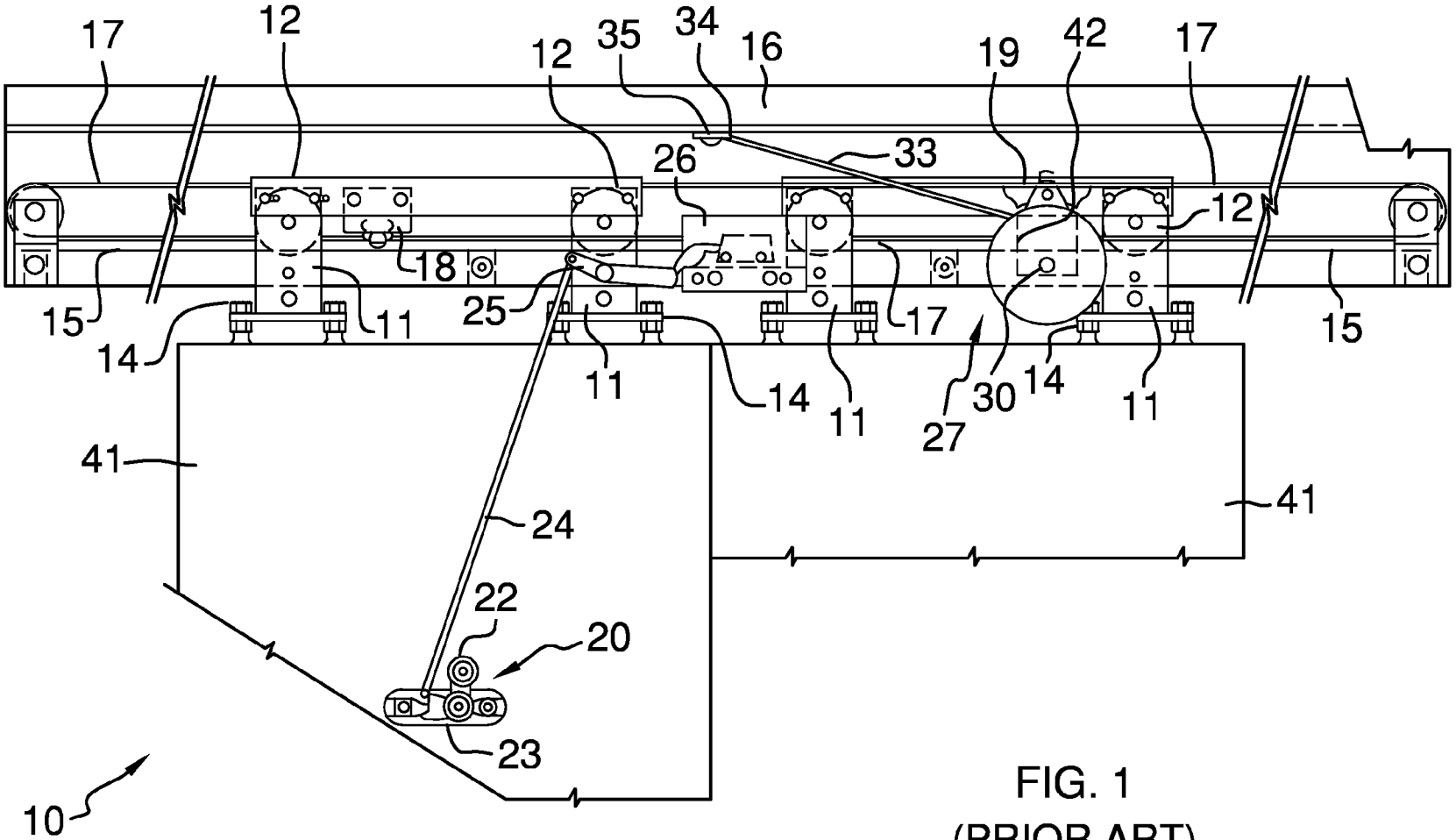
FIG. 1 (PRIOR ART)
FIG. 1 shows, in a partial side elevational view, a typical center opening hoistway door installation as may incorporate the teachings of the present invention.
Figure 2:
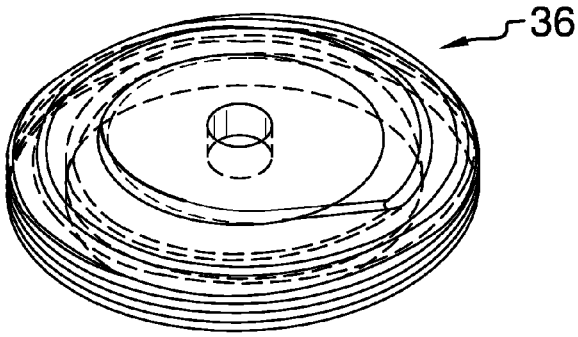
FIG. 2 shows, in perspective view, an elevator hoistway door closer as constructed according to the principles of the present invention.
Figure 4:
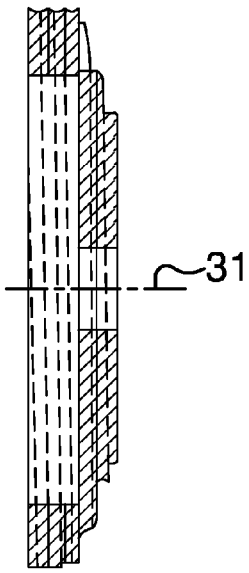
FIG. 4 shows, in a side view taken along the line C-C in FIG. 3, the door closer device of FIG. 2.
Figure 3:
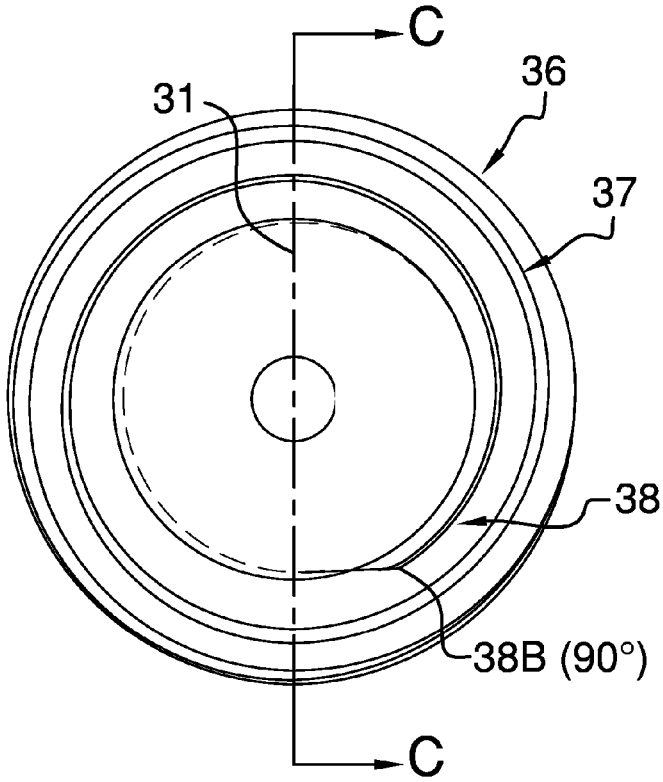
FIG. 3 shows, in a top view, the elevator hoistway door closer of FIG. 2.
Figure 5:
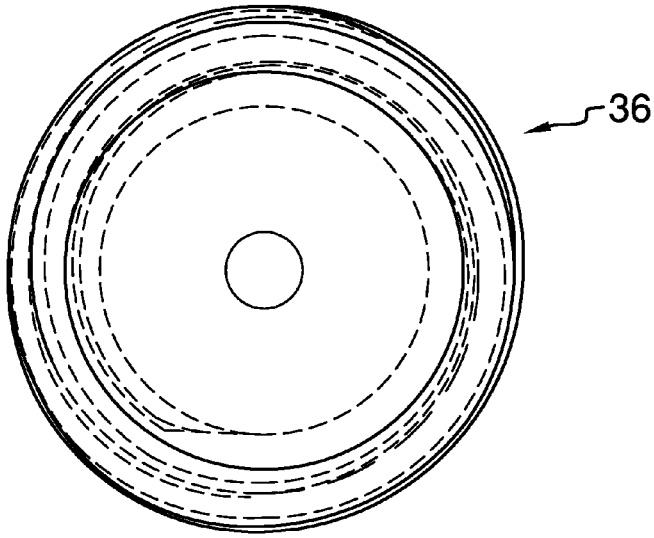
FIG. 5 shows, in a bottom view, the elevator hoistway door closer of FIG. 2.
Figure 6:
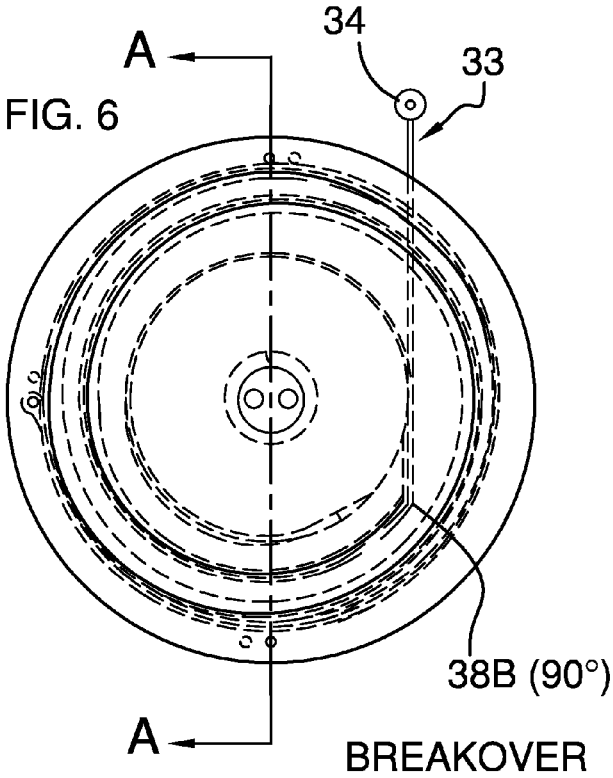
FIG. 6 shows, in a bottom view, the elevator hoistway door closer of FIG. 2 with a center hub, outer flange, and tensile wrap.
Figure 7:
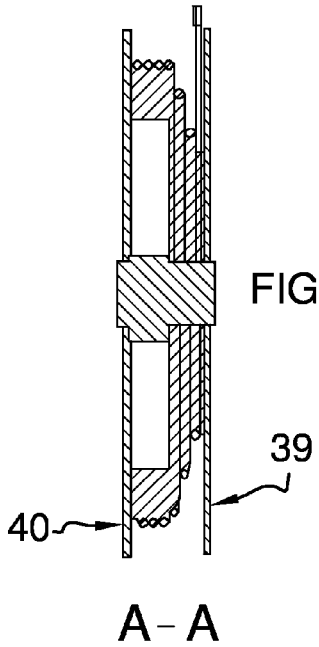
FIG. 7 shows, in a side view cross-section taken along the line A-A of FIG. 6, the elevator hoistway door closer of FIG. 2.

Referring now to the drawings, and particularly to FIGS. 2-9, a current embodiment of the elevator hoistway door closer of the present invention is shown and generally designated by the reference numeral 27.

In FIGS. 2-9, a new and improved elevator hoistway door closer 27 of the present invention for facilitating closure of elevator hoistway doors is illustrated and will be described. More particularly, the elevator hoistway door closer 27 is shown to generally comprise a sheave or reel 36 formed by providing an elongate channel 37 repeatedly about the circumference of the closer reel. In a preferred embodiment, the channel 37 forms a section of more-or-less constant diameter covering about two-thirds of one side of the reel, a conical helix shape 38 in approximately the last twelve inches of draw of the closer reel cable 33, and a breakover angle and flat channel 38B that the closer reel cable 33 encounters during the final two inches of draw. In particular, the positions of conical helix shape 38 and breakover angle and flat channel 38B are calculated so the cable 33 delivers a door closing force generated by the closer reel 36 that increases during the last movement of the cable 33 despite the fact that the spring 32 is delivering less force near the door closed position. The breakover angle in a current embodiment is 90°. This angle provides optimum tension, but any breakover angle between 80 and 110 degrees will enable the invention without deviating from its spirit and scope. This will be more fully explained hereinafter in conjunction with the description of FIGS. 10-13. The exact dimensions for the conical helix shape 38 will be consistent to any particular installation. As is also shown in the Figures, a top plate 39 and a bottom plate 40 are provided. The top plate 39 serves to ensure that the cable 33 will remain about the sheave 36 should the closer reel cable 33 become disengaged from the channel 37. After one cycle of the door closer device 27, the cable 33 will automatically reengage the channel 37.

In operation, the tension provided to the closer reel cable 33 from the spring 32, which ordinarily falls off during the final retraction of the cable 33 due to operation of spring 32 at the furthest extent of its effective region, is compensated by three factors. First, maintenance of the closer reel cable 33 within the channel 37 prevents overlapping of the cable 33, thereby maintaining the radius of the moment arm about the central axis 31 through the door closer device 27. Second, during the final refraction of the cable 33, direction of the closer reel cable 33 into the conical helix shape 38 reduces the radius of the moment arm about central axis 31. In this manner, the reduction in force resulting from operation in the weaker region of the spring 32 is counteracted by the design of the sheave 36. Third, in the last two inches of retraction, the closer reel cable 33 breaks over the 90° angle 38B. This increases the closure force exerted upon the cable 33 force exponentially and substantially decreases the amount of closure force required from the spring 32. This reduces wear on the spring and increases closing force at point where it is most needed, during the final two inches before the door closes.

FIGS. 10-13 are analogous to each other. Each shows the force produced by a spring of a particular door closer device and the resulting closing force transferred to the door by the cable. The door closed position is shown on the right, and the door open position is shown on the left. The slopes of the lines are exaggerated for purposes of illustration. The values in FIG. 13 for the force produced on the cable were obtained by attaching the cable to the hook of a weighing device of the type incorporating a spring. The force produced on the cable was measured at various distances from the door closer.

Figure 10:
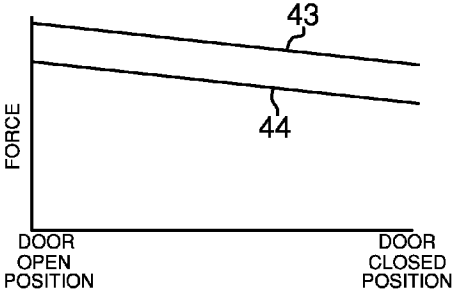
FIG. 10 (PRIOR ART)
FIG. 10 is a graph showing the relationship, in a conventional commercially available door closer, between spring force and tensile force.

FIG. 10 shows a line 43 representing the force produced by the spring of a conventional commercially available door closer and a line 44 representing the force produced on the end of the cable of a conventional commercially available door closer. A conventional commercially available door closer includes a spiral spring driving a reel of constant diameter on which the cable is wound. A typical commercially available door closure is Model ML-4402 available from the Hunter Spring Division of Ametek, Hatfield, Pa. A comparison of the lines 43 and 44 shows that the reel provides no mechanical advantage to the cable, which is predictable because the reel is of constant diameter.

It will be seen that the line 43, being above the line 44, shows that the spring delivers slightly more force than is delivered by the cable, the difference being lost in conventional mechanical ways, as through friction and the production of heat. It will also be seen that the spring and cable produce the minimum force when the door is at, or approaches, the door closed position and the maximum force when the door is at, or approaches, the door open position. In a way, this is logical because at the door open position, the door closer has to produce a maximum force to overcome inertia of the door and door closing mechanisms.

Figure 11:
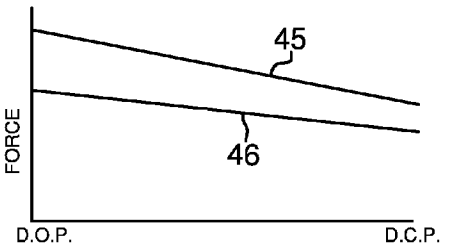
FIG. 11 (PRIOR ART)
FIG. 11 is a graph showing the relationship, in the door closing device disclosed in Australian Patent 113,360, between force produced by the spring and force produced by the end of the cable.

FIG. 11 shows a line 45 representing the force produced by the spring of the device shown in Australian Patent 113,360 and a line 46, representing the force produced on the end of the cable of a conventional commercially available door closer. This door closer device has a reel that is conical from back to front in a more-or-less constant manner. A comparison of the lines 45 and 46 shows that the reel provides an increasing mechanical advantage to the cable as the cable approaches the door open position, which is predictable because the reel is of minimum diameter at the door closed position and maximum diameter at the door open position.

Thus, the lines 45 and 46 diverge toward the door open position where the mechanical advantage is least. It will be seen that the line 45, being above the line 46, shows that the spring delivers slightly more force than is delivered by the cable, the difference being lost in conventional mechanical ways, as through friction and the production of heat.

Figure 12:
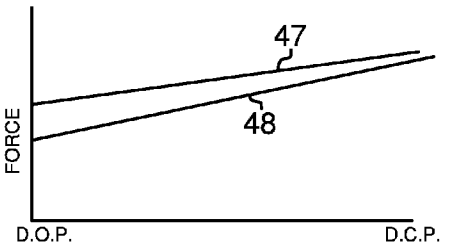
FIG. 12 (PRIOR ART)
FIG. 12 is a graph showing the relationship, in the door closing device disclosed in U.S. Pat. No. 3,311,159, between the force produced by the spring and the force produced by the cable.

FIG. 12 shows a line 47 representing the force produced by the spring of the device shown in U.S. Pat. No. 3,311,159 and a line 48 representing the force produced on the end of the cable of this device. This door closer has a reel which is conical from back to front. A comparison of lines 47 and 48 shows that the reel provides an increasing mechanical advantage to the cable as the door approaches the closed position to overcome the weight of the door and reduce force on the spring, which produces constant force on the cable from the door closed to the door open position. Thus line 47 representing the force delivered by the spring elevates to the maximum force at the door closed position and line 48 representing force delivered to the cable is more or less constant throughout. It will be seen that line 47 being above line 48 that the mechanical advantage of this closure is to reduce spring force and cable force when the door is in the open position.

Figure 13:
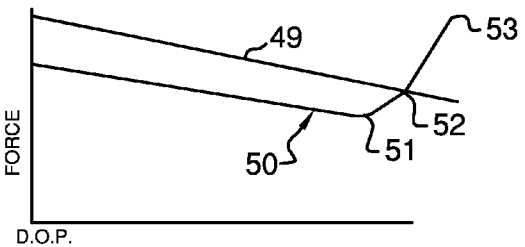
FIG. 13 is a graph showing the relationship, in an elevator hoistway door closer of FIG. 2, between the force produced by the spring and the force produced at the end of the cable.

FIG. 13 shows a line 49 representing the force produced by the spring of this invention. Line 50 represents the force produced on the cable during first 24 inches of retraction. Line 51 represents the force produced on the cable as it wraps on the first declining helix groove. Line 52 represents the force transmitted by the cable when it engages the breakover angle and flat channel 38B. Line 53 represents force transmitted by the cable at the door closed position.

Spiral springs of the type used in door closing devices produce force diagrams of substantially different shape and slope, depending on the design of the spring, and the line 49 is merely representative of a typical spiral spring. Thus, the line 49 is illustrated as generally linear which is a typical force diagram of a spiral spring of modern design. So far as is known, all commercially available spiral springs produce greater force when they are wound up, i.e. at the door open position, than when they are paid out, i.e. at the door closed position.

It will be seen that curve 51-53 is of a complex shape having a section 50 that is more or less parallel to line 49 and represents the situation where the cable is being wound or unwound off the large more-or-less constant diameter section of the reel or sheave 36. The shape of the curve changes at a location 51, which corresponds to the location where the cable begins to wind or unwind on the conical helix shape 38. The section 52 of the curve 51 shows that the force transmitted by the cable increases as the door approaches the door closed position so as to surpass the line 49 force produced by the spring as the door approaches the closed position. Line 53 shows that the force transmitted by the cable in the door closed position exceeds the force exerted by the spring on the cable in both the door open and door closed positions.

Thus, the door closer of this invention provides an optimally positioned closure force for the operation of hoistway doors. The maximum force of the spring is available at the door open position, which is advantageous to start movement of the door and overcome its inertia and the inertia of the door moving mechanisms shown in FIG. 1. However, instead of the closure force transmitted through the cable reducing or remaining constant at the door closed position, the force transmitted through the cable 33 increases exponentially. This occurs because of the design of the reel, so that even as the spring force decreases, the force is sufficient to overcome any extraneous forces on the door, such as "jet nozzle" or "wind tunnel" effects, which inhibit door closing. These effects are most prevalent during the last two inches of door closure, and are extremely strenuous on existing door closer devices.

Figure 9:
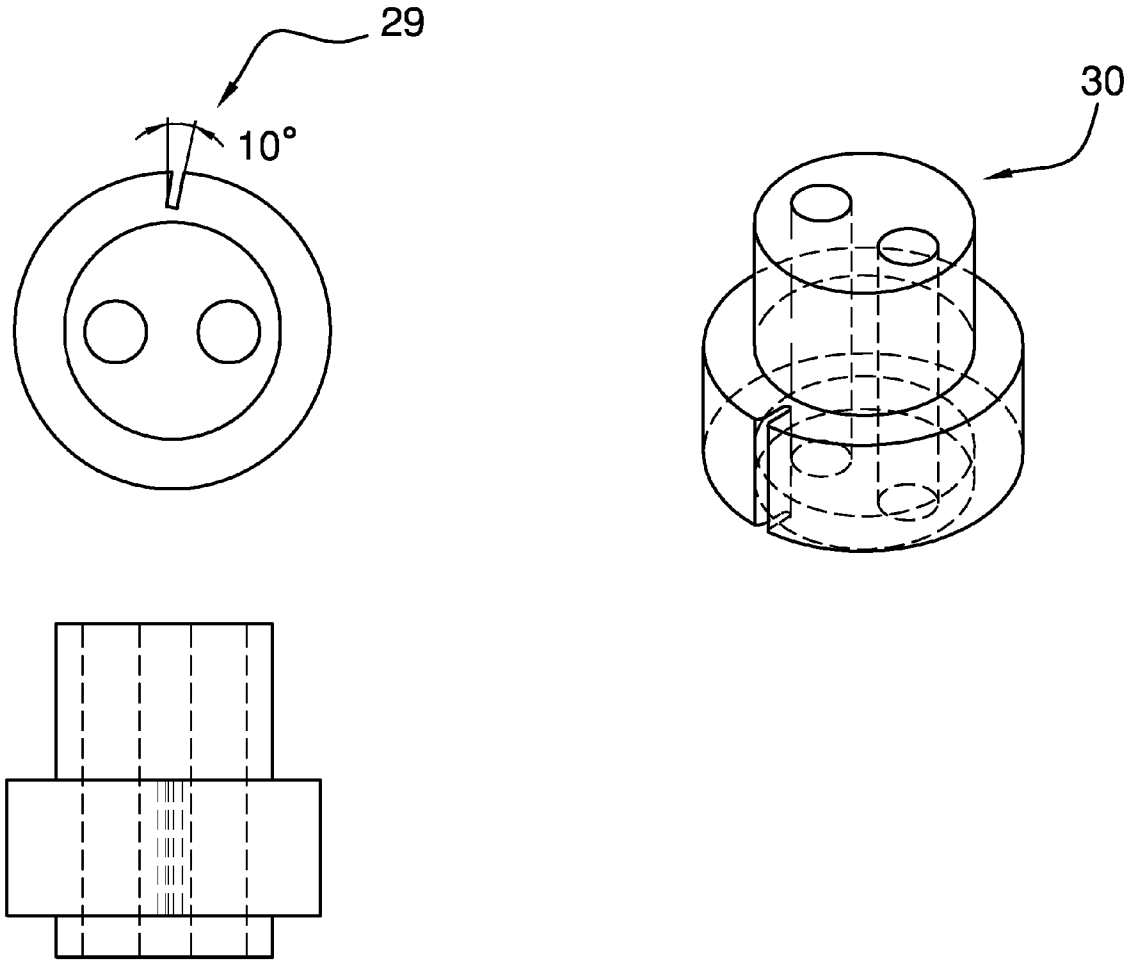
FIG. 9 shows, in a perspective view, the center hub of FIG. 6.

The ability to retrofit the door closer device of the present invention to existing elevator installations is accomplished by making the reel 36 of essentially the same diameter and thickness of existing door closer devices. In addition, the center hub shown in FIG. 9 is conforms to an industry standard size, thus allowing the door closer device of the present invention to be retrofitted to existing conventional commercial hoistway doors.

Applicant has found, through testing, that the force obtained as a result of this novel implementation is generally sufficient to overcome the jet nozzle effects of wind without the necessity for the repeated maintenance call-backs inherent in the designs of the prior art.

Figure 8:
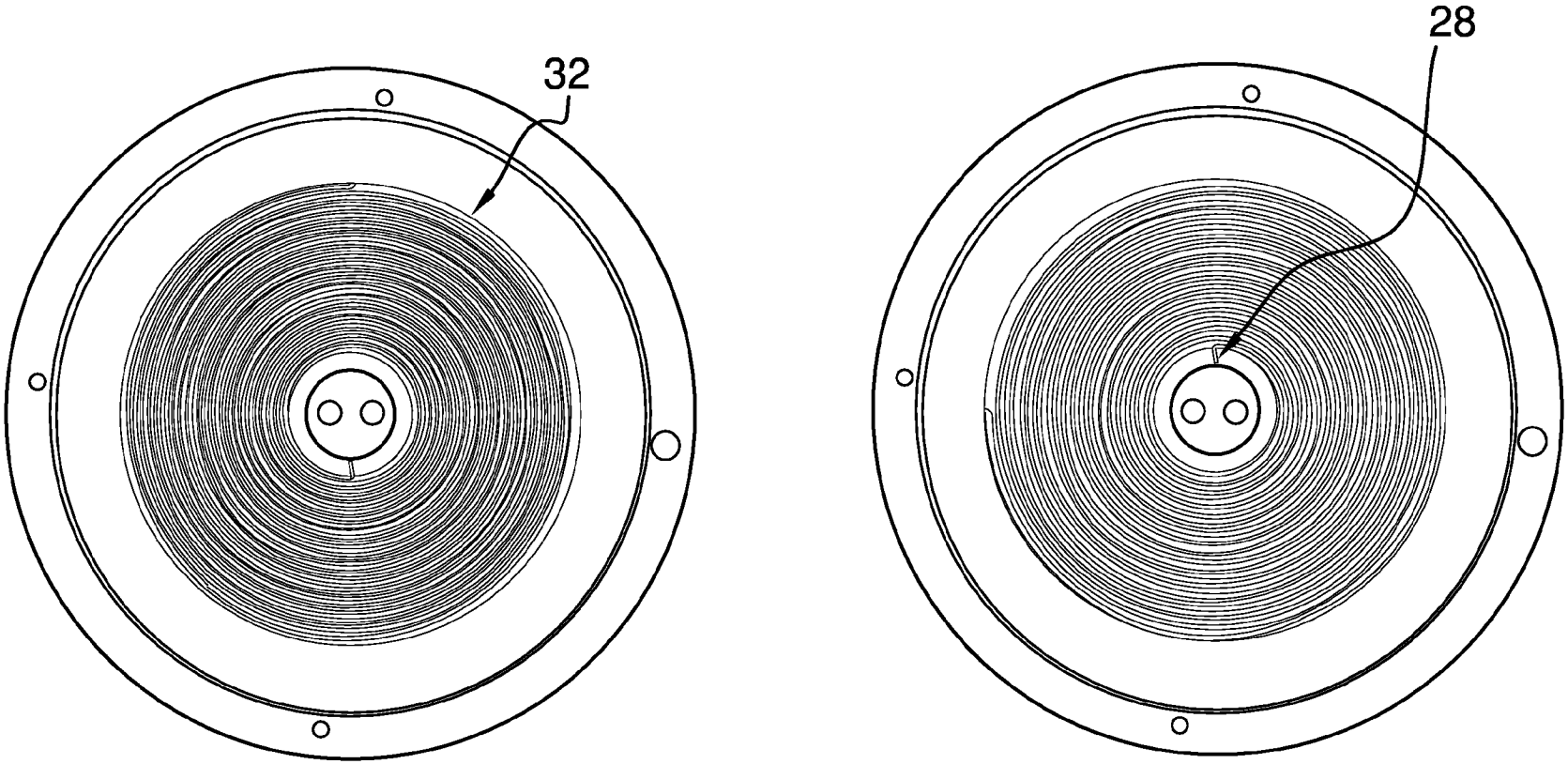
FIG. 8 shows, in a bottom cross-section view, the spring, cavity, center hub, and outer flange of the elevator hoistway door closer of FIG. 2.

Additionally, in the preferred embodiment of the present invention, Applicant has found that the cable lifetime may be extended through operation within the channel 37 because of the prevention of kinking and bending as the cable 33 would otherwise overlap itself Finally, because the sheave 36 of the present invention is preferably manufactured of a lubricant-impregnated plastics material, incorporating a material such as graphite, minimum friction with the cable 33 and the encased spring shown in FIG. 8 are generated, and the components coming into contact with the sheave 36 are protected from corrosion.

While a current embodiment of the door closer device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An elevator hoistway door closer comprising:

a reel having a central axis and a side;

a channel defined by a groove in the side of the reel;

the channel includes a first portion having a substantially constant diameter;

the channel includes a second portion having a conical helix shape having an initial end and a terminal end, said initial end attached to said first portion, the diameter of the second portion is substantially equal to the diameter of the first portion at the initial end and less than the diameter of the first portion at the terminal end; and the channel includes a third portion defined by a breakover angle at said terminal end of said second portion and a flat edge extending beyond said breakover angle, the diameter of the third portion is less than the diameter of the second portion;

an elongate tensile element having a first end fixed to the reel, the elongate tensile element is received by the first and second portions and passes over the third portion including said breakover angle and said flat edge, the elongate tensile element has a second end for attachment to a fixed point; and a spring for rotating the reel and retracting the elongate tensile element by wrapping the elongate tensile element around the first and second portions of the channel and over the third portion including said breakover angle and said flat edge;

wherein a tensile force transmitted by the elongate tensile element increases when the elongate tensile element encounters the second portion of the channel;

wherein the tensile force transmitted by the elongate tensile element after passing over the third portion including said breakover angle and said flat edge and being fully retracted exceeds a tensile force exerted by the spring when the elongate tensile element is fully withdrawn from the reel.

2. The elevator hoistway door closer of claim 1, wherein the first portion of the channel covers about two-thirds of the side of the reel.

3. The elevator hoistway door closer of claim 1, wherein said breakover angle is between 80 and 110 degrees.

4. The elevator hoistway door closer of claim 1, wherein the elongate tensile element encounters the second portion of the channel during about the last 12 inches of retraction.

5. The elevator hoistway door closer of claim 1, wherein the elongate tensile element encounters the third portion including said breakover angle and said flat edge during about the last 2 inches of retraction.

6. The elevator hoistway door closer of claim 1, further comprising a top plate attached to one end of the reel adjacent to the second portion of the channel.

7. The elevator hoistway door closer of claim 1, further comprising a bottom plate attached to one end of the reel adjacent to the first portion of the channel.

8. The elevator hoistway door closer of claim 1, further comprising: a central passage defined by a bore extending through the central axis of the reel; and a bearing assembly positioned within the central passage.

* * * * *